US009423184B2

(12) United States Patent
Yoshida et al.

(10) Patent No.: US 9,423,184 B2
(45) Date of Patent: Aug. 23, 2016

(54) DRAINAGE STRUCTURE FOR CORRUGATED-FIN HEAT EXCHANGER

(75) Inventors: Takeshi Yoshida, Shizuoka (JP); Kazuhiko Yamazaki, Shizuoka (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 280 days.

(21) Appl. No.: 14/125,736

(22) PCT Filed: Apr. 2, 2012

(86) PCT No.: PCT/JP2012/002257

§ 371 (c)(1), (2), (4) Date: Dec. 12, 2013

(87) PCT Pub. No.: WO2012/172716

PCT Pub. Date: Dec. 20, 2012

(65) Prior Publication Data

US 2014/0109609 A1 Apr. 24, 2014

(30) Foreign Application Priority Data

Jun. 16, 2011 (JP) ..... 2011-134034

(51) Int. Cl.

| | |
|---|---|
| ***F25D 21/14*** | (2006.01) |
| ***F28D 1/053*** | (2006.01) |
| ***F28F 17/00*** | (2006.01) |
| ***F28F 1/12*** | (2006.01) |
| *F25B 39/02* | (2006.01) |
| *F28F 1/26* | (2006.01) |

(52) U.S. Cl.

CPC ..... *F28D 1/05383* (2013.01); *F25D 21/14* (2013.01); *F28F 1/128* (2013.01); *F28F 17/005* (2013.01); *F25B 39/022* (2013.01); *F25B 2500/01* (2013.01); *F28F 1/26* (2013.01)

(58) Field of Classification Search

CPC .... F28D 1/05383; F25D 21/14; F28F 17/005; F28F 1/128; F28F 1/26; F25B 39/022; F25B 2500/01

See application file for complete search history.

(56) References Cited

U.S. PATENT DOCUMENTS

2008/0314076 A1* 12/2008 Ichiyanagi ..... F25B 9/008 62/513
2012/0272677 A1 11/2012 Furumaki et al.

FOREIGN PATENT DOCUMENTS

JP 2010-25477 A 2/2010
JP 2010-243147 A 10/2010

(Continued)

OTHER PUBLICATIONS

English translation of International Preliminary Report on Patentability and Written Opinion issued Dec. 17, 2013, in PCT International Application No. PCT/JP2012/002257.

(Continued)

*Primary Examiner* — Emmanuel Duke
(74) *Attorney, Agent, or Firm* — Birch, Stewart, Kolasch & Birch, LLP

(57) ABSTRACT

A corrugated-fin heat exchanger is constructed by arranging a plurality of flat heat exchange tubes parallel to each other in a horizontal direction between a pair of opposing header pipes, joining, at a position between the plurality of flat heat exchange tubes, corrugated fins formed by alternately repeating peak folding and valley folding portions, and forming water flow passages from lug pieces that are obtained by obliquely cutting and raising flange portions extending along end portions of each of the plurality of flat heat exchange tubes (3) in a width direction thereof. A pitch (P) of each of the corrugated fins between a peak and a valley thereof, a width (L) of each of the lug pieces in a vertical direction thereof, and a thickness (T) of the each of the plurality of flat heat exchange tubes have a relationship of $P \times 2 \geq L \geq T$.

9 Claims, 6 Drawing Sheets

(56) References Cited

FOREIGN PATENT DOCUMENTS

| | | | |
|---|---|---|---|
| JP | 2010243147 A | * | 10/2010 |
| WO | 2010/106757 A1 | | 9/2010 |

OTHER PUBLICATIONS

International Search Report, issued in PCT/JP2012/002257, dated Jun. 26, 2012.

* cited by examiner

DRAINAGE STRUCTURE FOR CORRUGATED-FIN HEAT EXCHANGER

TECHNICAL FIELD

The present invention relates to a drain structure for a corrugated-fin heat exchanger, and more specifically, to a drain structure that is enhanced in drainage of a parallel flow heat exchanger having corrugated fins and flat heat exchange tubes alternately arranged therein.

BACKGROUND ART

In general, a corrugated-fin heat exchanger is widely used, which is constructed by arranging a plurality of flat heat exchange tubes parallel to one another in a horizontal direction between a pair of opposing header pipes, and joining corrugated fins between the heat exchange tubes. In a case where this type of corrugated-fin heat exchanger is used as an evaporator, condensed water (dew water) adheres to the surface thereof, which increases an airflow resistance, and further, inhibits heat transfer due to a resistance of a water film adhering to the surfaces of the corrugated fins. As a result, there arises a problem of decrease in heat exchange performance.

Further, in this type of corrugated-fin heat exchanger, considering the water retention property of the corrugated fins, it is preferred that the fin pitch be increased. When the fin pitch is increased, however, there is such a trade-off problem that the area of heat transfer on the air side is reduced. Thus, it is necessary to consider the fin pitch and the area of heat transfer on the air side.

In order to solve the above-mentioned problem, the inventors of the present invention have conducted extensive study, and eventually proposed such a drain structure that water flow passages are formed by obliquely cutting and raising flange portions extending along end portions of each heat exchange tube in a width direction thereof, and are provided at an appropriate pitch in a longitudinal direction of the heat exchange tube (see, for example, Patent Literature 1).

According to the technology described in Patent Literature 1, the water flow passages for inducing water retained between the corrugated fins adjacent to an upper side and a lower side of each heat exchange tube are formed by obliquely cutting and raising the flange portions, and thus the condensed water (dew water) adhering to the surface of the heat exchanger can be drained.

CITATION LIST

Patent Literature

[PTL 1] JP 2010-243147 A (Scope of Claims, FIGS. 1 to FIG. 3)

SUMMARY OF INVENTION

Technical Problem

In the technology described in Patent Literature 1, the water flow passages formed by obliquely cutting and raising the flange portions extending along the end portions of each flat heat exchange tube in the width direction thereof are shaped (dimensioned) so as to fall within a range of four times or less as large as the pitch of each corrugated fin.

However, the above-mentioned limitation to the range is insufficient alone. For example, in a case where the angle of cutting and raising the flange portions is small and the thickness of the heat exchange tube is relatively large, a given drainage is secured, but there is a risk in that the drain rate is extremely decreased. Therefore, there is room to further enhance the drainage.

The present invention has been made in view of the above-mentioned circumstances, and it is therefore an object thereof to provide a drain structure for a corrugated-fin heat exchanger that is enhanced in drainage in consideration of a thickness of a heat exchange tube and a pitch of a corrugated fin.

Solution to Problem

In order to achieve the above-mentioned object, according to one embodiment of the present invention, there is provided a drain structure for a corrugated-fin heat exchanger, the corrugated-fin heat exchanger being constructed by arranging a plurality of flat heat exchange tubes parallel to each other in a horizontal direction between a pair of opposing header pipes, joining, at a position between the plurality of flat heat exchange tubes, corrugated fins formed by alternately repeating peak folding portions and valley folding portions, and forming water flow passages from lug pieces that are obtained by obliquely cutting and raising flange portions extending along end portions of each of the plurality of flat heat exchange tubes in a width direction thereof, in which a plurality of the lug pieces formed in the each of the plurality of flat heat exchange tubes are arrayed at appropriate intervals along a longitudinal direction of the each of the plurality of flat heat exchange tubes, and in which a pitch (P) of each of the corrugated fins between a peak and a valley thereof, a width (L) of each of the lug pieces in a vertical direction thereof, and a thickness (T) of the each of the plurality of flat heat exchange tubes have a relationship of $P \times 2 \geq L \geq T$.

In one embodiment of the present invention, it is preferred that the width (L) of the each of the lug pieces, the thickness (T) of the each of the plurality of flat heat exchange tubes, and an angle ($\theta$) of the each of the lug pieces have a relationship of $L \times \sin\theta = T$.

Further, in one embodiment of the present invention, it is preferred that the width of the each of the lug pieces be 2 mm or more. When the width of the each of the lug pieces is less than 2 mm, the process becomes difficult.

In addition, it is preferred that a thickness of the each of the lug pieces be 0.2 mm to 0.8 mm. The reason is as follows. When the thickness of the each of the lug pieces is smaller than 0.2 mm, a shearing process becomes difficult due to an extremely small appropriate clearance of a processing cutter tool. When the thickness of the each of the lug pieces is larger than 0.8 mm, on the other hand, a great sharing force is necessary, which may limit the strength of the processing cutter tool and the processing method.

According to the present invention described above, under a state in which the condensed water (dew water) in the form of water droplets, which is condensed on the surface of the each of the corrugated fins, is retained between the corrugated fins adjacent to the upper and lower sides of the each of the plurality of flat heat exchange tubes, the end portions of the each of the lug pieces are brought into contact with the retained water, and therefore serve as a start point of the water fall. As a result, the water can be induced and drained to the lower corrugated fin. Subsequently, in the same manner, the water can be drained to the lower corrugated fin.

Further, in one embodiment of the present invention, it is preferred that the drain structure for a corrugated-fin heat exchanger include a side plate joined to a lower opening side of the corrugated fins that are located at a lowermost end, and that the side plate include a drain slit provided at a center portion of the side plate along a longitudinal direction of the side plate. In addition, alternatively, it is preferred that the side plate include: a horizontal piece held in contact with the corrugated fins; and a vertical piece bending at one end portion of the horizontal piece in a direction orthogonal thereto, and that the vertical piece include drain ditches formed at intervals along a longitudinal direction of the side plate over a range from a lower end of the vertical piece to an intersecting portion between the vertical piece and the horizontal piece, the drain ditches each having a width smaller than the pitch of the each of the corrugated fins.

With this configuration, the water stagnating between the corrugated fins at the lowermost end portion can be drained downward.

Advantageous Effects of Invention

According to the present invention, under a state in which the water droplets adhering to the heat exchanger are retained between the corrugated fins, the end portions of the each of the lug pieces are brought into contact with the retained water, and therefore serve as the start point of the water fall. As a result, the water can be induced and drained reliably to the lower corrugated fin. Thus, even in a case where the flat heat exchange tubes are arranged in the horizontal direction, the drain rate can be increased and the drainage can be enhanced.

DESCRIPTION OF EMBODIMENTS

Now, referring to the accompanying drawings, detailed description is given of embodiments of the present invention.

Figure 1:
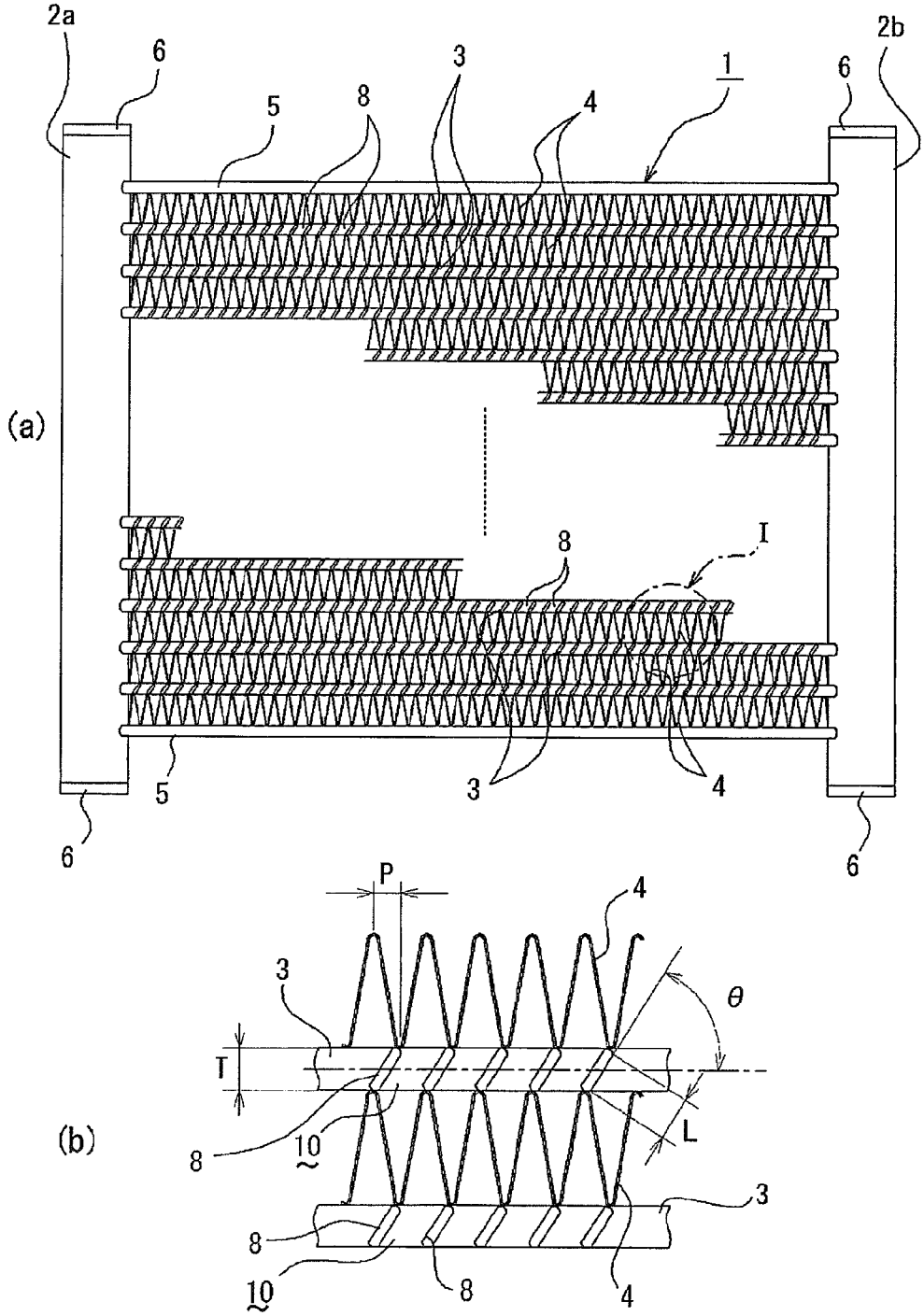
FIG. 1(*a*) is a front view illustrating an example of a drain structure for a corrugated-fin heat exchanger according to the present invention, and FIG. 1(*b*) is an enlarged front view in the portion I of FIG. 1(*a*).

As illustrated in FIG. 1, a corrugated-fin heat exchanger 1 according to the present invention includes a pair of laterally opposing header pipes 2*a* and 2*b* each made of aluminum (including aluminum alloy), a plurality of flat heat exchange tubes 3 bridged (continuously provided) in parallel to one another in a horizontal direction between the header pipes 2*a* and 2*b*, and corrugated fins 4 each interposed between adjacent heat exchange tubes 3, the heat exchange tubes 3 and the corrugated fins 4 being brazed to the header pipes 2*a* and 2*b*.

In this case, the heat exchange tube 3 has a plurality of sectioned heating medium passages 3*a* formed therein. Further, on the upper outside and the lower opening side of the corrugated fins 4 at the upper and lower ends, side plates 5 made of aluminum are brazed, respectively. Further, at the upper and lower opening ends of the header pipes 2*a* and 2*b*, end caps 6 made of aluminum are brazed, respectively.

In the heat exchanger 1 having the above-mentioned configuration, the corrugated fin 4 is formed by repeatedly accordion-folding a thin plate to have a predetermined height. In front view of the heat exchanger, the corrugated fin 4 may be viewed as successive V-shapes. Note that, the shape of the corrugated fin 4 may not necessarily be the successive V-shapes but successive U-shapes.

Figure 2:
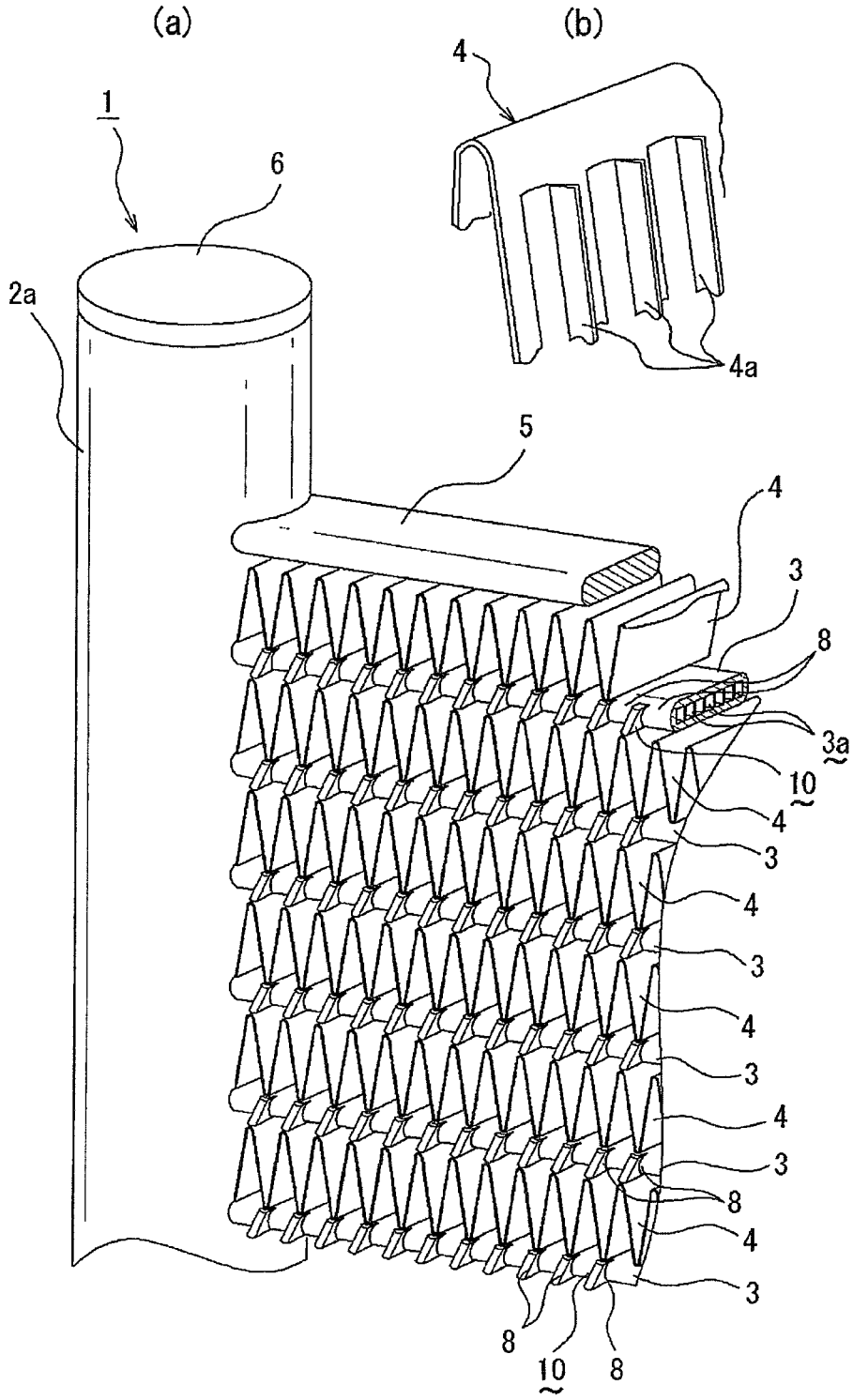
FIG. 2(*a*) is a perspective view illustrating a partial cross section of the drain structure according to the present invention, and FIG. 2(*b*) is a partially enlarged perspective view of a corrugated fin according to the present invention.
Figure 3:
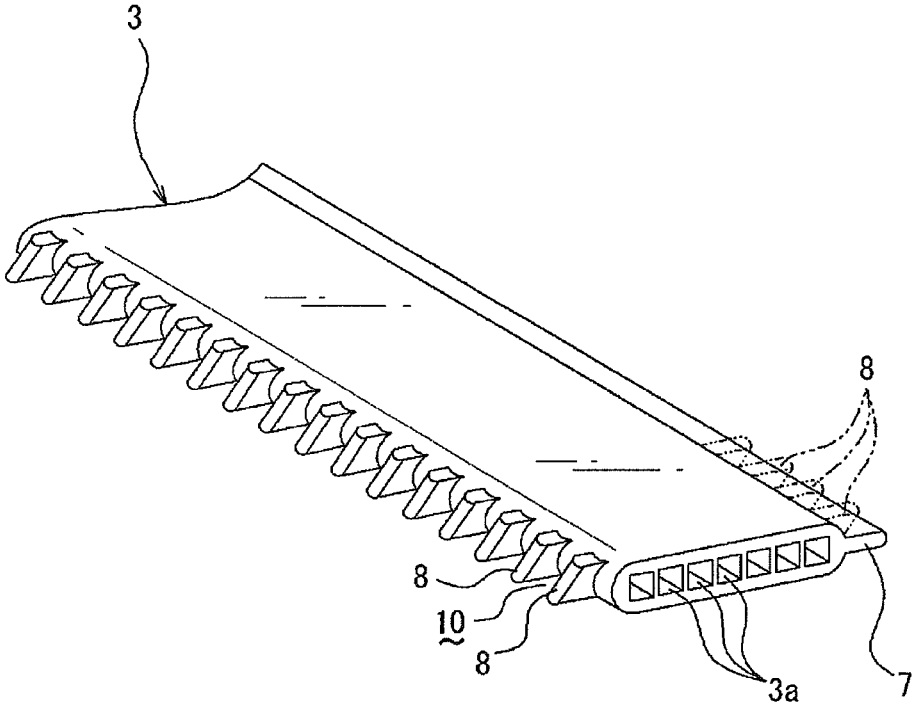
FIG. 3 is a perspective view illustrating a heat exchange tube having water flow passages according to the present invention.

In the heat exchanger 1 having the above-mentioned configuration, as illustrated in FIGS. 1 to 3, on a side end portion of the heat exchange tube 3 in the width direction thereof, a flange portion 7 is provided so as to extend along a longitudinal direction of the heat exchange tube 3, and water flow passages 10 for induing water retained between the corrugated fins 4 adjacent to the upper and lower sides of the heat exchange tube 3 are formed by arraying a plurality of lug pieces 8, which are obtained by obliquely cutting and raising the flange portion 7 via cutouts at an appropriate pitch and by bringing the upper and lower end portions of the lug pieces 8 into contact with the corrugated fins 4.

As a method of forming the lug piece 8 serving as the water flow passage 10, as illustrated in FIG. 3, the heat exchange tube 3 having the flange portions 7 extending at both end portions thereof is formed by extrusion molding, and then each flange portion 7 is subjected to a cutting and raising process or the like via cutouts to form the lug piece 8. In this case, when the width (length) of the lug piece 8 in a vertical direction is extremely small, the process becomes difficult, and hence the width (length) of the lug piece 8 is preferably 2 mm or more.

Note that, the thickness of the lug piece 8 is preferably 0.2 mm to 0.8 mm from the viewpoint of easiness of a shearing process. The reason is as follows. When the thickness of the lug piece is smaller than 0.2 mm, the shearing process becomes difficult due to an extremely small appropriate clearance of a processing cutter tool. When the thickness of the lug piece is larger than 0.8 mm, on the other hand, a great sharing force is necessary, which may limit the strength of the processing cutter tool and the processing method.

The drain mechanism according to the present invention has the following configuration. Because no water passage to the lower stage is provided with respect to the condensed water (dew water), which is condensed on the surface of a V-shaped (valley-folded) fin, the condensed water moves to an adjacent inverse-V-shaped (mountain-folded) portion via fin louvers 4*a* (see FIG. 2(*b*)), which are formed by cutting and raising a plurality of longitudinal slits provided in parallel to one another in the width direction of the corrugated fin 4. The condensed water accumulated in the inverse-V-shaped portion flows into a lower corrugated fin 4 through a lower opening portion via the water flow passages 10 formed in the heat exchange tube 3. By smoothly repeating such a mechanism, the condensed water is prompted to be drained.

Note that, by providing the fin louvers 4*a* to the corrugated fin 4, heat exchange performance can be improved, that is, by providing a predetermined number of louvers formed in the air passage at a predetermined angle, heat transfer performance can be improved due to a turbulence effect or the like.

In this drain mechanism, it is desired that the water flow passage 10 formed in the heat exchange tube 3 be arranged to couple the corrugated fins 4 located on both sides of the water flow passage 10, that is, on both sides of the heat exchange tube 3 in the thickness direction thereof. Therefore, the width of the lug piece 8 is restricted by the thickness of the heat exchange tube 3. Further, it is preferred that the width of the lug piece 8 be equal to or smaller than twice as large as a pitch of the corrugated fin between the peak and the valley thereof.

Based on the above-mentioned relationship, it is possible to express optimum ranges of the dimensions and angle of the respective portions, that is, the heat exchange tube 3, the corrugated fin 4, and the lug piece 8.

Specifically, referring to FIG. 4, a relationship among a pitch (P) of the corrugated fin 4 between the peak and the valley thereof, a width (L) of the lug piece 8, and a thickness (T) of the heat exchange tube 3 can be expressed as follows: $P \times 2 \geq L \geq T$ Further, when "θ" represents the angle of the lug piece 8 with respect to a center line of the heat exchange tube 3, the following expression is established: $L \times \sin\theta = T$ <Evaluation Test>

Next, description is given of an evaluation test for examining the optimum ranges of the dimensions and angle of the respective portions, that is, the heat exchange tube 3, the corrugated fin 4, and the lug piece 8 according to the present invention.

Figure 4:
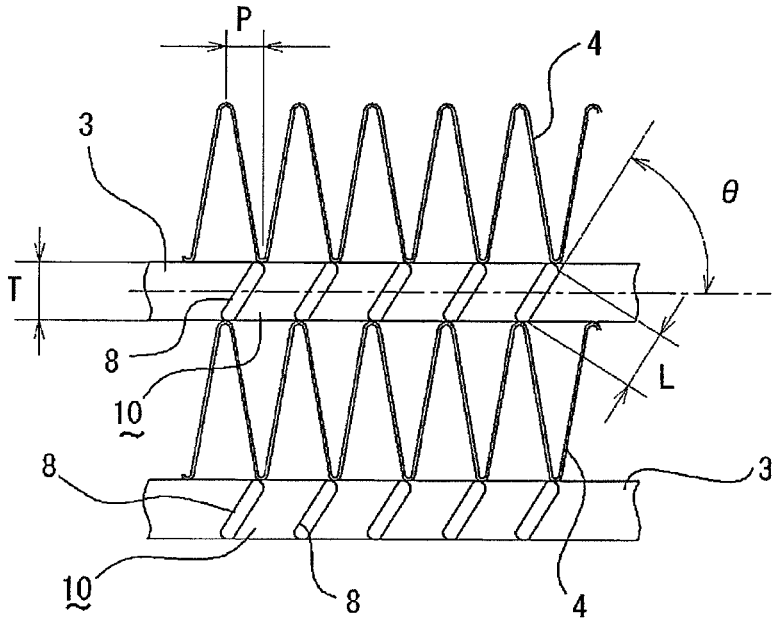
FIG. 4 is a schematic front view illustrating a relationship among the heat exchange tube, the corrugated fin, and a lug piece according to the present invention.

The evaluation test was conducted in a case where, in FIG. 4, the pitch (P) of the corrugated fin 4 between the peak and the valley thereof was 1.2 mm, 1.4 mm, 1.6 mm, or 1.8 mm, the width (L) of the lug piece 8 was 1.2 mm, 1.6 mm, 2 mm, 2.4 mm, 2.8 mm, 3.2 mm, 3.6 mm, or 4 mm, the thickness of the lug piece 8 was 0.5 mm, and the thickness (T) of the heat exchange tube 3 was 1.2 mm, 1.6 mm, or 2 mm. The angle (θ) was set under the conditions that $L \times \sin\theta = T$ when $L \geq T$ and $L \times \sin\theta$ = maximum when $L < T$. The evaluation was conducted on the following four-point scale: "drain rate is high and drainage is excellent" (◎), "drainage is excellent" (○), "drain function is secured but rate is low" (Δ), and "drainage is low or drain is impossible" (×). Consequently, results as shown in Table 1 were obtained.

TABLE 1

| Thickness of tube (mm) | Width of lug piece (mm) | Fin pitch (mm) 1.2 | 1.4 | 1.6 | 1.8 |
|---|---|---|---|---|---|
| 1.2 | 1.2 | ○ | ○ | ○ | ○ |
| | 1.6 | ○ | ◎ | ◎ | ◎ |
| | 2 | ○ | ◎ | ◎ | ◎ |
| | 2.4 | ○ | ○ | ◎ | ◎ |
| | 2.8 | Δ | ○ | ◎ | ◎ |
| | 3.2 | Δ | Δ | ○ | ◎ |
| | 3.6 | Δ | Δ | Δ | ○ |
| | 4 | Δ | Δ | Δ | Δ |
| 1.6 | 1.2 | X | X | X | X |
| | 1.6 | ○ | ○ | ○ | ○ |
| | 2 | ○ | ◎ | ◎ | ◎ |
| | 2.4 | ○ | ○ | ◎ | ◎ |
| | 2.8 | Δ | ○ | ◎ | ◎ |
| | 3.2 | Δ | Δ | ○ | ◎ |
| | 3.6 | Δ | Δ | Δ | ○ |
| | 4 | Δ | Δ | Δ | Δ |
| 2 | 1.2 | X | X | X | X |
| | 1.6 | X | X | X | X |
| | 2 | ○ | ○ | ○ | ○ |
| | 2.4 | ○ | ○ | ◎ | ◎ |
| | 2.8 | Δ | ○ | ◎ | ◎ |
| | 3.2 | Δ | Δ | ○ | ◎ |
| | 3.6 | Δ | Δ | Δ | ○ |
| | 4 | Δ | Δ | Δ | Δ |

◎ Drain rate is high and drainage is excellent
○ Drainage is excellent
Δ Drain function is secured but rate is low
X Drainage is low or drain is impossible As a result of the above-mentioned evaluation test, it was found that the range of $P \times 2 \geq L \geq T$ was the optimum range. From this result, in a practical example, under the condition that the condensed water is not relatively easily generated on the surface of the heat exchanger, when the fin pitch (P) is 1.3 mm and the tube thickness (T) is 1.93 mm, a lug piece width (L) of 2.6 mm and a lug piece angle (θ) of 48° are obtained in combination.

Under the condition that the condensed water is easily generated on the surface of the heat exchanger, on the other hand, the fin pitch (P) is preferably about 1.6 mm focusing on the water retention property of the corrugated fin 4. In this case, when the tube thickness (T) is 1.93 mm, a lug piece width (L) of 2.6 mm and a lug piece angle (θ) of 48° are obtained in combination.

According to the drain structure of the embodiment described above, when the surface of the heat exchanger becomes wet, the condensed water (dew water) in the form of water droplets, which is condensed on the surface of the corrugated fin 4, is retained between the corrugated fins 4 adjacent to the upper and lower sides of the heat exchange tube 3. In this state, the edge portions of the lug piece 8 (water flow passage 10) held in contact with the corrugated fins 4 are brought into contact with the retained water, and therefore serve as a start point of the water fall. As a result, the water can be induced and drained to the lower corrugated fin 4. Subsequently, in the same manner, the condensed water (dew water) in the form of water droplets, which is condensed on the surface of the corrugated fin 4, is sequentially drained to the lower corrugated fin 4. Further, at least one lug piece 8 is arranged for each peak of the corrugated fin 4, with the result that the water can be drained smoothly. Thus, even in a case where the flat heat exchange tubes 3 are arranged in the horizontal direction, the drain rate can be increased and the drainage can be enhanced.

Note that, in the corrugated-fin heat exchanger 1 according to the present invention, the following structure is preferred so as to efficiently drain water adhering to and stagnating at the corrugated fins 4 located at the lowermost end.

Figure 5:
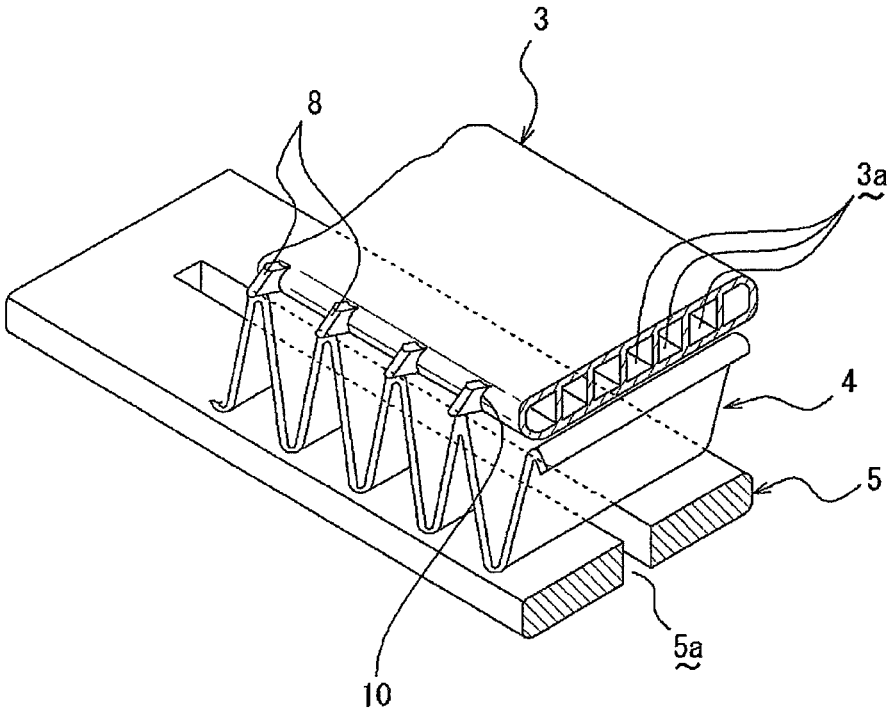
FIG. 5 is a perspective view illustrating a cross section of a main portion of a corrugated-fin heat exchanger according to one embodiment of the present invention, in which a drain structure is provided in a lower side plate.

For example, in this structure, as illustrated in FIG. 5, at a center portion of the lower side plate 5 located at the lowermost end, a drain slit 5*a* is provided along a longitudinal direction of the side plate 5. When the drain slit 5*a* is thus provided in the lower side plate 5 located at the lowermost end along the longitudinal direction of the side plate 5, a water passage communicating in a lateral direction of the corrugated fins 4 can be formed, with the result that the water stagnating between the corrugated fins 4 at the lowermost end portion can be induced therebelow by the drain slit 5*a*.

Figure 6:
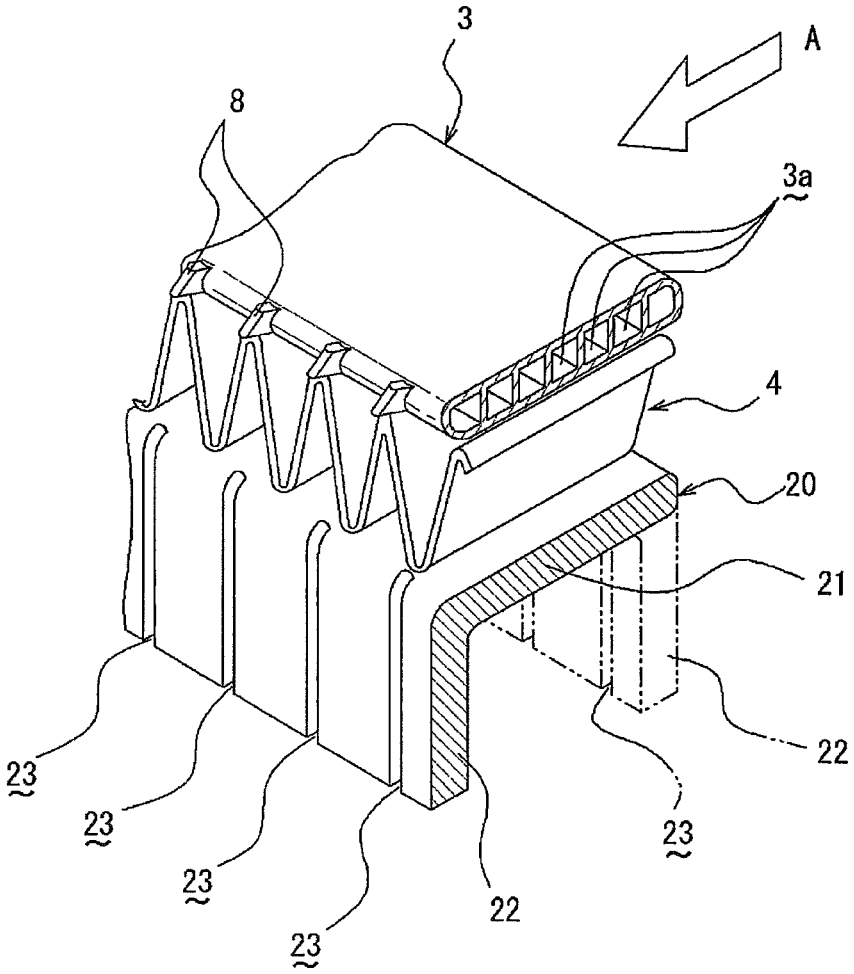
FIG. 6 is a perspective view illustrating a cross section of a main portion of a corrugated-fin heat exchanger according to another embodiment of the present invention, in which a drain structure is provided in a lower side plate.

Further, as another structure, as illustrated in FIG. 6, a lower side plate 20 located below the corrugated fins 4 at the lowermost end of the corrugated-fin heat exchanger 1 according to the present invention is formed of an angulated side channel, which is formed of an aluminum extruded profile including a horizontal piece 21 held in contact with lower ends of the corrugated fins 4 at the lowermost end, and a vertical piece 22 bending at one end of the horizontal piece 21 in a direction orthogonal thereto. In the vertical piece 22, a plurality of drain ditches 23 are formed at appropriate intervals along a longitudinal direction of the side plate 20 over a range from a lower end of the vertical piece 22 to an intersecting portion between the vertical piece 22 and the horizontal piece 21. In this case, the width of each drain ditch 23 is set smaller than the pitch of the corrugated fin 4.

In FIG. 6, the vertical piece 22 provided in the lower side plate 20 is located on a leeward side of an air A. Alternatively, as indicated by the two-dot chain line, the vertical piece 22 may be located on a windward side of the air A, or still alternatively, the side channel may be formed into a C-shape so that the vertical piece 22 is located on both the windward side and the leeward side of the air A.

According to the structure described above, the plurality of drain ditches 23 formed over the range from the lower end of the vertical piece 22 to the intersecting portion between the vertical piece 22 and the horizontal piece 21 are provided in the vertical piece 22 of the side plate 20. Thus, the water adhering to and stagnating at the corrugated portion of the corrugated fins 4 at the lowermost portion can be induced into the drain ditches 23 due to a capillary phenomenon, and the water induced into the drain ditches 23 can be drained downward from the drain ditches 23 due to potential energy (gravity).

Note that, the embodiment described above is directed to the case where the drain structure according to the present invention is applied to an evaporator. However, even in a case where the present invention is applied to a parallel flow corrugated-fin heat exchanger other than the evaporator and the heat exchange tubes are arranged in the horizontal direction, it is possible to provide a sufficient drainage of water droplets adhering to the surface thereof, and to thereby suppress an adverse effect on an airflow resistance and a heat exchange efficiency.

REFERENCE SIGNS LIST

1 heat exchanger
2*a*, 2*b* header pipe
3 heat exchange tube
4 corrugated fin
4*a* fin louver
7 flange portion
8 lug piece
9 thick portion
10 water flow passage
P pitch of corrugated fin
L width of lug piece
T thickness of heat exchange tube
θ angle of lug piece

The invention claimed is:

1. A drain structure for a corrugated-fin heat exchanger, the corrugated-fin heat exchanger being constructed by arranging a plurality of flat heat exchange tubes parallel to each other in a horizontal direction between a pair of opposing header pipes, joining, at a position between the plurality of flat heat exchange tubes, corrugated fins formed by alternately repeating peak folding portions and valley folding portions, and forming water flow passages from lug pieces that are obtained by obliquely cutting and raising flange portions extending along end portions of each of the plurality of flat heat exchange tubes in a width direction thereof, wherein a plurality of the lug pieces formed in the each of the plurality of flat heat exchange tubes are arrayed at appropriate intervals along a longitudinal direction of the each of the plurality of flat heat exchange tubes, wherein a pitch (P) of each of the corrugated fins between a peak and a valley thereof, a width (L) of each of the lug pieces in a vertical direction thereof, and a thickness (T) of the each of the plurality of flat heat exchange tubes have a relationship of $P \times 2 \geq L \geq T$, wherein the drain structure for the corrugated-fin heat exchanger comprises a side plate joined to a lower opening side of the corrugated fins that are located at a lowermost end, and wherein the side plate comprises a drain slit provided at a center portion of the slide plate along a longitudinal direction of the side plate.

2. The drain structure for the corrugated-fin heat exchanger according to claim 1, wherein the width (L) of the each of the lug pieces, the thickness (T) of the each of the plurality of flat heat exchange tubes, and an angle (θ) of the each of the lug pieces have a relationship of $L \times \sin\theta = T$.

3. The drain structure for the corrugated-fin heat exchanger according to claim 2, wherein the width of the each of the lug pieces is 2 mm or more.

4. The drain structure for the corrugated-fin heat exchanger according to claim 2, wherein a thickness of the each of the lug pieces is 0.2 mm to 0.8 mm.

5. The drain structure for the corrugated-fin heat exchanger according to claim 1, wherein the width of the each of the lug pieces is 2 mm or more.

6. The drain structure for the corrugated-fin heat exchanger according to claim 5, wherein a thickness of the each of the lug pieces is 0.2 mm to 0.8 mm.

7. The drain structure for the corrugated-fin heat exchanger according to any one of claims 3 to 6, wherein the side plate comprises:

a horizontal piece held in contact with the corrugated fins; and a vertical piece bending at one end portion of the horizontal piece in a direction orthogonal thereto, and wherein the vertical piece comprises drain ditches formed at intervals along a longitudinal direction of the side plate over a range from a lower end of the vertical piece to an intersecting portion between the vertical piece and the horizontal piece, the drain ditches each having a width smaller than the pitch of the each of the corrugated fins.

8. The drain structure for the corrugated-fin heat exchanger according to claim 1, wherein a thickness of the each of the lug pieces is 0 2 mm to 0.8 mm.

9. The drain structure for the corrugated-fin heat exchanger according to any one of claims 1 to 8, wherein the side plate comprises:

a horizontal piece held in contact with the corrugated fins; and a vertical piece bending at one end portion of the horizontal piece in a direction orthogonal thereto, and wherein the vertical piece comprises drain ditches formed at intervals along a longitudinal direction of the side plate over a range from a lower end of the vertical piece to an intersecting portion between the vertical piece and the horizontal piece, the drain ditches each having a width smaller than the pitch of the each of the corrugated fins.

* * * * *